US010961677B2

(12) United States Patent
Maher et al.

(10) Patent No.: US 10,961,677 B2
(45) Date of Patent: Mar. 30, 2021

(54) MONITORING SYSTEM FOR MARINE RISERS

(71) Applicant: Trendsetter Vulcan Offshore, Inc., Houston, TX (US)

(72) Inventors: James V. Maher, Houston, TX (US); Kim Mittendorf, Houston, TX (US)

(73) Assignee: TRENDSETTER VULCAN OFFSHORE, INC.

( * ) Notice: Subject to any disclaimer, the term of this patent is extended or adjusted under 35 U.S.C. 154(b) by 153 days.

(21) Appl. No.: 16/467,691

(22) PCT Filed: Dec. 13, 2017

(86) PCT No.: PCT/US2017/066154

§ 371 (c)(1),
(2) Date: Jun. 7, 2019

(87) PCT Pub. No.: WO2018/112062

PCT Pub. Date: Jun. 21, 2018

(65) Prior Publication Data

US 2020/0071898 A1 Mar. 5, 2020

Related U.S. Application Data

(60) Provisional application No. 62/434,195, filed on Dec. 14, 2016.

(51) Int. Cl.
*E02B 17/00* (2006.01)
*E21B 17/01* (2006.01)
(Continued)

(52) U.S. Cl.
CPC ..... *E02B 17/0034* (2013.01); *E21B 17/01* (2013.01); *E21B 41/0007* (2013.01); *E21B 47/007* (2020.05)

(58) Field of Classification Search
CPC .... E02B 17/0034; E21B 47/007; E21B 17/01; E21B 41/0007
See application file for complete search history.

(56) References Cited

U.S. PATENT DOCUMENTS

2004/0074649 A1 4/2004 Hatton et al.
2006/0065401 A1 3/2006 Allen et al.
(Continued)

FOREIGN PATENT DOCUMENTS

CN 202066671 U 12/2011

OTHER PUBLICATIONS

Sonardyne, "Marksman MRAMS, marine riser angle monitoring system," brochure, Oct. 2015, 4 pages.
(Continued)

*Primary Examiner* — Tara Mayo-Pinnock
(74) *Attorney, Agent, or Firm* — Jonathan Pierce; Pierre Campanac; Porter Hedges LLP

(57) ABSTRACT

A monitoring system for use in a marine riser system coupled to a rig vessel includes one or more subsea inertial measurement units adapted for mounting to a lower end of a riser, an LMRP, or both. The one or more subsea inertial measurement units may acquire time series data of inclination and acceleration. The one or more subsea inertial measurement units may transmit, to a vessel transceiver, frequency data computed from the time series data, low-pass filtered values of the time series data, or both. The monitoring system includes a surface processing unit that is in communication with the vessel transceiver. The surface processing unit may be programmed to compute, for example, fatigue along the marine riser system, the difference between the inclination of the lower end of the riser and the inclination of the LMRP, or both, by applying predetermined functions to the transmitted data.

17 Claims, 5 Drawing Sheets

(51) Int. Cl.

| | |
|---|---|
| ***E21B 41/00*** | (2006.01) |
| ***E21B 47/00*** | (2012.01) |
| ***E21B 47/007*** | (2012.01) |

(56) References Cited

U.S. PATENT DOCUMENTS

| | | | |
|---|---|---|---|
| 2007/0056742 | A1 | 3/2007 | Hatton |
| 2007/0240526 | A1 | 10/2007 | Fowler et al. |
| 2008/0128138 | A1 | 6/2008 | Radi |
| 2016/0312565 | A1 | 10/2016 | Papadimitriou et al. |

OTHER PUBLICATIONS

International Search Report and Written Opinion for parent PCT application PCT/US2017/066154, 11 pages.

MONITORING SYSTEM FOR MARINE RISERS

BACKGROUND

This disclosure relates generally to methods and apparatus for monitoring the dynamics of marine riser systems.

Marine riser systems extend the wellbore from the subsea wellhead to the floating drilling vessel. They usually include a Blow Out Preventer (BOP) stack, a Lower Marine Riser Package (LMRP) and a riser. They provide for fluid returns to the drilling rig, support the choke, kill, and control lines, and guides tools into the well. Their length may reach twelve thousand feet or more.

The vibrations of a marine riser system cause fatigue of the wellhead by cyclic loads repeatedly applied to it, and fatigue of the riser between the LMRP and surface. Because the dynamics of the marine riser system involves several modes of vibrations, each having vibrations nodes and anti-nodes at different locations, multiple sensors, distributed sufficiently densely over the length the marine riser system, have been required to monitor these vibrations. Because of the complexity and cost of distributed sensor systems, these systems have remained uncommon.

Thus, there is a continuing need in the art for methods and apparatus for monitoring the dynamics of a marine riser system. These methods and apparatus are preferably more practical and economical than distributed sensor systems. Monitoring systems for marine risers preferably provide measurements that can be used to perform several of the following functions: dynamic positioning of a drilling rig above a wellbore, using angle measurement between the riser and the LMRP, determination of riser dynamics and fatigue, and determination of wellhead fatigue.

SUMMARY

A marine riser system usually includes a wellhead, an LMRP and a riser. The LMRP is coupled to the wellhead. A lower end of the riser is coupled to the LMRP. The disclosure describes a monitoring system for use in such marine riser system.

The monitoring system comprises a first subsea inertial measurement unit adapted for mounting to the lower end of the riser. The first subsea inertial measurement unit includes means for acquiring time series data of inclination and acceleration.

In some embodiments, the first subsea inertial measurement unit further includes means for computing frequency spectra of time series data. The means for computing frequency spectra of time series data may further be programmed to compress the frequency spectra. The first subsea inertial measurement unit further includes means for transmitting the data from the frequency spectra to a vessel transceiver. The means for transmitting the data to the vessel transceiver may be programmed to transmit a rolling window of the spectra upon receiving a ping from the vessel transceiver. The means for transmitting the data to the vessel transceiver may further be programmed to transmit a filtered value of the time series data of the inclination upon receiving the ping from the vessel transceiver, and/or may further include means for transmitting filtered values of the time series data to the vessel transceiver.

The monitoring system may further comprise a second subsea inertial measurement unit adapted for mounting to the LMRP. The second subsea inertial measurement unit may include means for acquiring time series data of inclination and acceleration. The second subsea inertial measurement unit may further include means for computing frequency spectra of time series data. The second subsea inertial measurement unit may further include means for transmitting the data frequency spectra to the vessel transceiver. The means for transmitting the frequency data to the vessel transceiver may be programmed to transmit a rolling window of the spectra upon receiving a ping from the vessel transceiver. The means for transmitting the frequency data to the vessel transceiver may further be programmed to transmit a low-pass filtered value of the time series data of the inclination upon receiving the ping from the vessel transceiver, and/or may further include means for transmitting low-pass filtered values of the time series data to the vessel transceiver.

The monitoring system comprises a surface processing unit that is in communication with the vessel transceiver.

In some embodiments, the surface processing unit may be programmed to apply predetermined functions to the transmitted data to compute stress levels at a plurality of locations along the riser, the LMRP, or the wellhead. The surface processing unit may further be programmed to compute and display fatigue of the riser or the LMRP based on the computed stress levels.

In some embodiments, the surface processing unit may be programmed to apply predetermined functions to the transmitted data for computing the inclination or the acceleration of the LMRP. The surface processing unit may further be programmed to display a difference between the inclination of the lower end of the riser and the inclination of the LMRP. The surface processing unit may further be programmed to transmit the difference between the inclination of the lower end of the riser and the inclination of the LMRP to a dynamic positioning system. The surface processing unit may further be programmed to apply predetermined functions to the inclination or the acceleration of the LMRP for computing a load applied to the wellhead, and caused by the inclination or acceleration of the LMRP. The surface processing unit may further be programmed to compute fatigue of the wellhead from the computed load applied to the wellhead and display the computed fatigue.

In some embodiments, the surface processing unit may be programmed to apply predetermined functions to the low-pass filtered values for computing the inclination or the acceleration of the LMRP. The surface processing unit may further be programmed to display a difference between the inclination of the lower end of the riser and the inclination of the LMRP. The surface processing unit may further be programmed to transmit the difference between the inclination of the lower end of the riser and the inclination of the LMRP to a dynamic positioning system. The surface processing unit may further be programmed to apply predetermined functions to the inclination or the acceleration of the LMRP for computing the load applied to the wellhead, and caused by the inclination or acceleration of the LMRP. The surface processing unit may further be programmed to compute fatigue of the wellhead from the computed load applied to the wellhead and display the computed fatigue.

BRIEF DESCRIPTION OF THE DRAWINGS

For a more detailed description of the embodiments of the disclosure, reference will now be made to the accompanying drawings, wherein.

DETAILED DESCRIPTION

Figure 1:
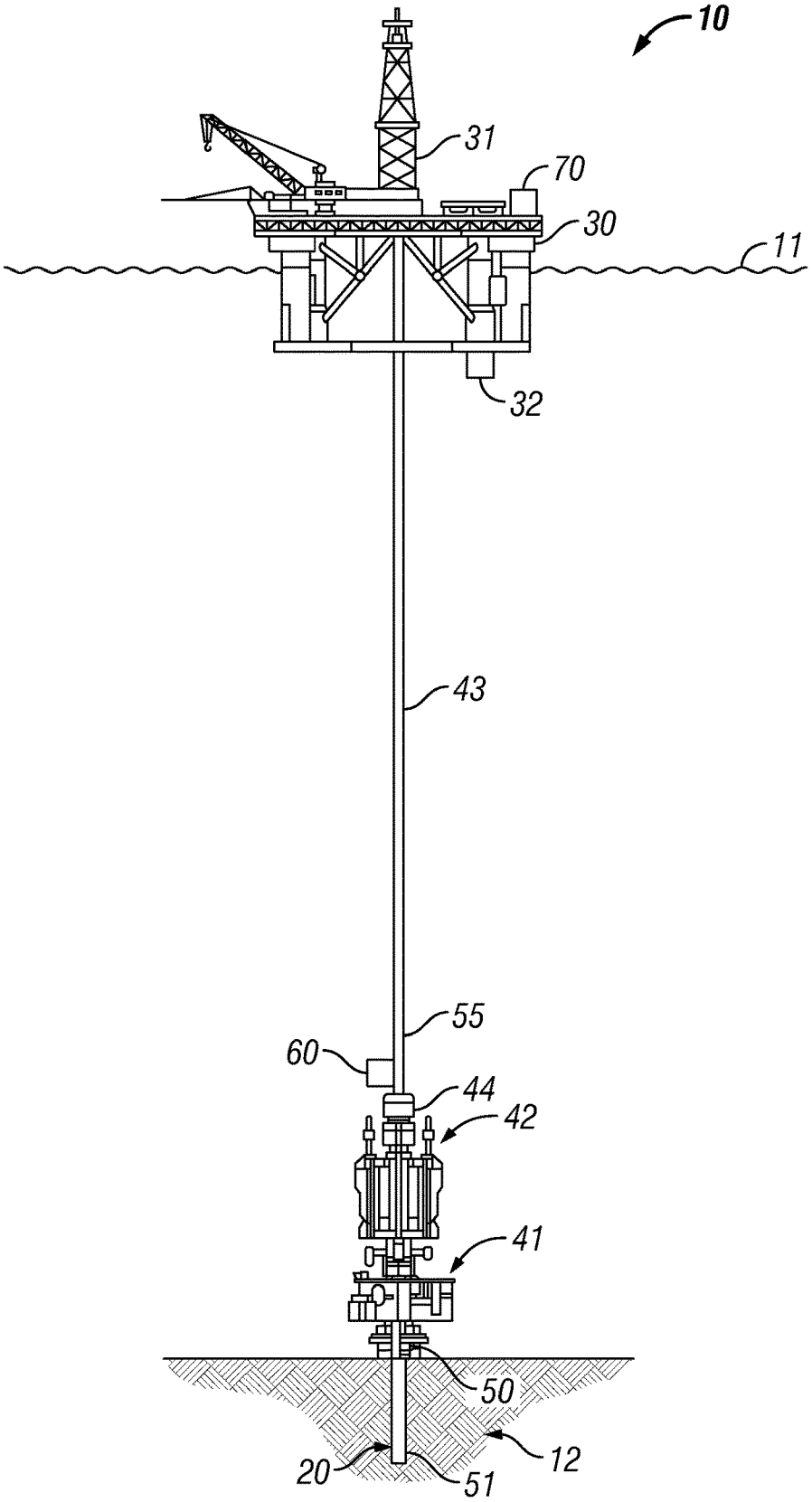
FIG. 1 is a monitoring system for a marine riser in accordance with an embodiment having one or more subsea inertial measurement unit.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, an offshore drilling operation is illustrated. A drilling rig 30, floating on sea surface 11, is positioned over a wellbore 20 extending below the sea floor 12. The drilling rig 30 may be dynamically positioned to maintain alignment of a derrick 31 with a wellbore axis 55. The construction of the wellbore 20 may include a casing 51 connected to a wellhead 50. The wellbore 20 is extended from the wellhead 50 to the drilling rig 30 by a marine riser system that may include a BOP 41, an LMRP 42, and a riser 43. The riser 43 may be coupled to the LMRP 42 by a flex joint 44. A system 10 is provided for monitoring the dynamics of the marine riser system.

In this embodiment, the monitoring system 10 may comprise a single subsea inertial measurement unit 60 including means for acquiring time series data of inclination and acceleration of the lower end of the riser 43, means for computing frequency spectra of time series data, and means for transmitting frequency data to a vessel transceiver 32. The subsea inertial measurement unit 60 is mounted to the lower end of the riser 43, for example using straps, clamps, or other means. The location where the subsea inertial measurement unit 60 is mounted may be selected from a modal analysis of the marine riser system that is performed, for example, with a Finite Element Method. Preferably, the location is selected along the riser 43 where all modes that are expected to contribute to the fatigue of the marine riser system have a non-zero amplitude of inclination. Generally, there are at least two locations where all modes usually have a non-zero amplitude: at the top of the riser 43 and at the bottom of the riser 43. The location at the bottom of the riser 43 may be preferred because inclination and acceleration at the bottom of the riser 43 are indicative of, or more directly influenced by, the inclination of the LMRP 42, the wellhead 50, and the lower end of the riser 43. Thus, the location where the subsea inertial measurement unit 60 is mounted may be selected, for example, right above the flex joint 44.

The monitoring system 10 further comprises a surface processing unit 70 in communication with the vessel transceiver 32 and programmed to apply predetermined functions to the frequency data to compute stress levels at a plurality of locations along the riser 43 or the wellhead 50.

Figure 2:
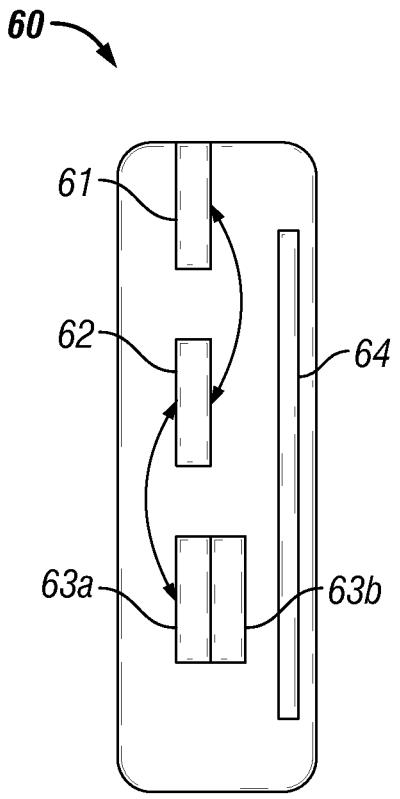
FIG. 2 is a subsea inertial measurement unit for use in the monitoring system shown in FIG. 1.

Turning to FIG. 2, the subsea inertial measurement unit 60 for use in the monitoring system 10 shown in FIG. 1 is illustrated. The subsea inertial measurement unit 60 is adapted for mounting to the marine riser system and moving in unison with the portion of the marine riser system it is mounted to. As such, the subsea inertial measurement unit 60 may be mounted to the lower end of the riser 43, and accordingly, may measure the inclination and acceleration of the lower end of the riser 43. The subsea inertial measurement unit 60 may be powered by a battery 64.

For acquiring time series data of inclination and acceleration, the subsea inertial measurement unit 60 includes a 2-axis or a 3-axis inclinometer **63*a*, and a 2-axis or a 3-axis accelerometer 63*b*. The inclinometer 63*a* may include a gyroscope or equivalent, or another inclinometer known in the art. The accelerometer 63*b* may include a piezoelectric element or equivalent, or another accelerometer known in the art. The subsea inertial measurement unit 60 also includes electronic circuits coupled to a volatile memory, such that the signals from the inclinometer 63*a* and accelerometer 63*b*** are digitized, sampled at regular time interval, and stored in the volatile memory. Thus, the electronic circuits are configured for buffering time series data of inclination and acceleration in the volatile memory.

For computing frequency spectra of time series data, the subsea inertial measurement unit 60 includes a digital processing unit 62. For example, the digital processing unit 62 may include a non-volatile computer storage, such as a flash memory or equivalent, for storing machine instructions to be executed by a digital signal processor or equivalent. The digital processing unit 62 may also read data from the volatile memory that is used for buffering time series data of inclination and acceleration. The digital processing unit 62 is programmed to compute frequency spectra and store the spectra in memory. The digital processing unit 62 is also programmed to compute low-pass filtered values. The volatile memory may also be used to store frequency spectra and/or low-pass filtered values. The digital processing unit 62 may additionally or alternatively include other electronic components, such as field-programmable gate arrays (FPGA), for example, to communicate digital signals to and from the digital processing unit 62. Optionally, the digital processing unit 62 may be used to apply predetermined functions as discussed hereinafter.

For transmitting frequency data to the vessel transceiver 32, the digital processing unit 62 may also encode a binary representation of the frequency data using phase-shift keying or equivalent. The digital processing unit 62 may also be programmed to generate a carrier wave, which phase is modulated based on the phase-shift keying. The subsea inertial measurement unit 60 includes electronic circuits coupled to a hydro-acoustic transponder 61 or equivalent, for example, a piezoelectric hydrophone. The hydro-acoustic transponder 61 is configured to emit the modulated carrier wave. The hydro-acoustic transponder 61 may also be coupled to electronics so that it can be used as a detector, such as a ping detector as explained below.

In addition, the subsea inertial measurement unit 60 may optionally include non-volatile computer storage, such as a flash memory or equivalent, for storing one or more of time series data of inclination and acceleration, frequency spectra, low-pass filtered values, stress levels and/or fatigue.

Figure 3:
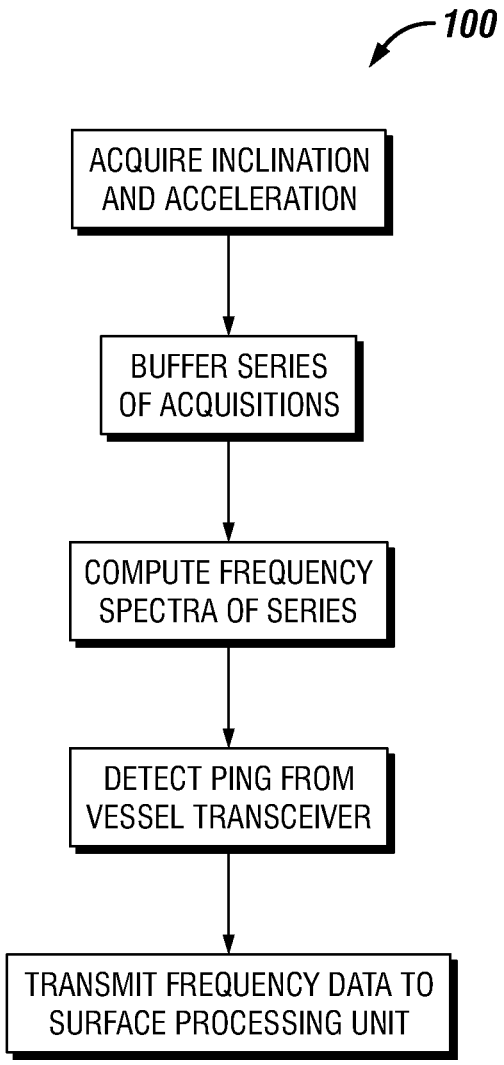
FIG. 3 is a flowchart of a firmware algorithm for the subsea inertial measurement unit shown in FIG. 2.

Turning to FIG. 3, a flowchart 100 of a firmware algorithm is illustrated. The algorithm may be coded by machine instructions and may be executed by the digital signal processor of the subsea inertial measurement unit 60. A shown in the flowchart 100, the machine instructions may cause the digital signal processor to acquire time series data of inclination and acceleration from the inclinometer 63*a* and the accelerometer 63*b*. These digital signals may be buffered, for a duration of fifteen minutes for example. After sufficient data are acquired, the machine instructions may cause the digital signal processor to compute frequency spectra of the time series data, for example using a fast Fourier transform algorithm.

In operation, an FPGA associated with the hydro-acoustic transponder 61 may be programmed to retrieve frequency data representative of an entire spectrum computed over a duration of fifteen minutes, and send these frequency data every fifteen minutes. The frequency data may, in this example, be computed by compressing the entire spectrum. Accordingly, the digital signal processor may further be programmed to compress the frequency spectra, and the frequency data transmitted to the vessel transceiver 32 may consist of compressed data. In addition, the vessel transceiver 32 may emit a ping, every five seconds, for example, that is detected by the hydro-acoustic transponder 61. Upon receiving the ping from the vessel transceiver 32, the FPGA associated with the hydro-acoustic transponder 61 may be programmed to send a low-pass filtered value of the time series data of the inclination and/or acceleration. Thus, the frequency data and the low-pass filtered values may be sent to the vessel transceiver 32 at different time intervals, for example, every fifteen minutes for the frequency data, and every five seconds for the low-pass filtered values.

In another embodiment, the vessel transceiver 32 may emit a ping, every five seconds, for example, that is detected by the hydro-acoustic transponder 61. Upon receiving the ping from the vessel transceiver 32, an FPGA associated with the hydro-acoustic transponder 61 may be programmed to retrieve frequency data consisting of a rolling window of the spectra computed by the digital signal processor, and transmit these frequency data to the surface processing unit 70 via the vessel transceiver 32. For example, the rolling window may include the value of one of the spectrum at one frequency every time a ping is received, and the frequency may be incremented between every ping until the entire spectra are transmitted, and transmission of newly computed spectra starts. The rolling window of the spectra may alternatively include the values of one of the spectra at a set of frequencies, and the set of frequencies is changed between every ping until the entire spectra are transmitted. Further, the rolling window of the spectra may alternatively include the values of different spectra or other combinations. The FPGA associated with the hydro-acoustic transponder 61 may further be programmed to transmit a low-pass filtered value of the time series data of the inclination and/or acceleration interleaved with frequency data.

In both embodiments, the low-pass filtered values of the time series data of the inclination that are sent to the vessel transceiver 32 may be used for the dynamic positioning of the drilling rig 30 over the wellbore 20, and/or to determine whether drilling operations are suitable.

It should be noted that while the flowchart 100 is illustrated as sequential in FIG. 3, the acquisition of a next time series data of inclination and acceleration may be carried out in parallel with the transmission of the frequency data computed on previously acquired time series data of inclination and acceleration.

Figure 4:
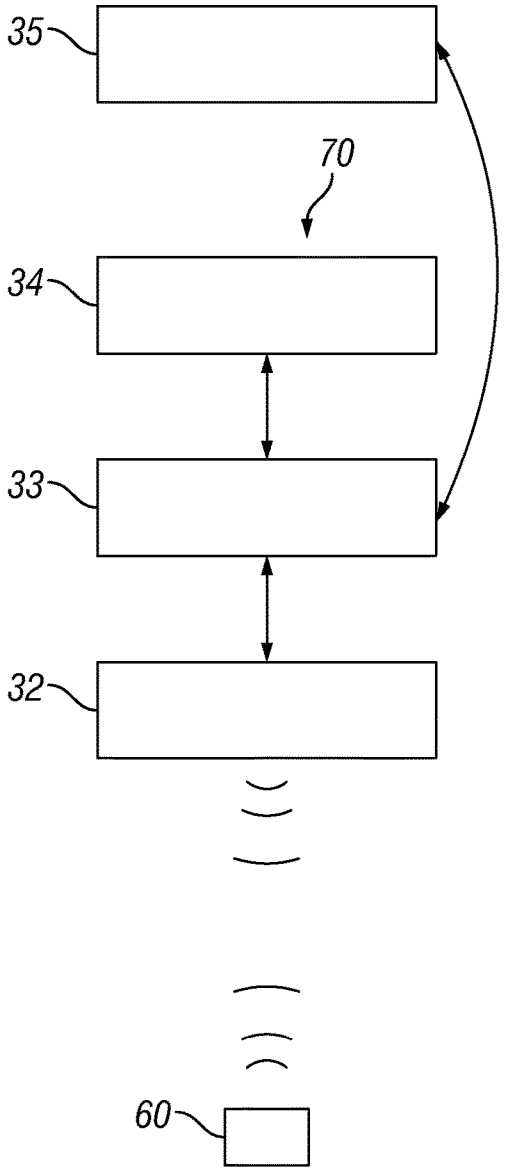
FIG. 4 is a surface processing unit and a vessel transceiver for use in the monitoring system shown in FIG. 1.

Turning to FIG. 4, the surface processing unit 70 for use in the monitoring system 10 shown in FIG. 1 is illustrated. The surface processing unit 70 is preferably, but not exclusively, located on the drilling rig 30. Alternatively, the surface processing unit 70 may be implemented onshore, or partially on the drilling rig 30 and partially onshore. For example, access to a database, and automation may be performed onshore, and processing may be performed on the drilling rig 30. The surface processing unit 70 is in communication with the vessel transceiver 32, which in turn is in communication with the subsea inertial measurement unit 60. The surface processing unit 70 may include a programmable computer 33 and a display 34. In some embodiments, the surface processing unit 70 is integrated with a dynamic positioning system 35.

Figure 5:
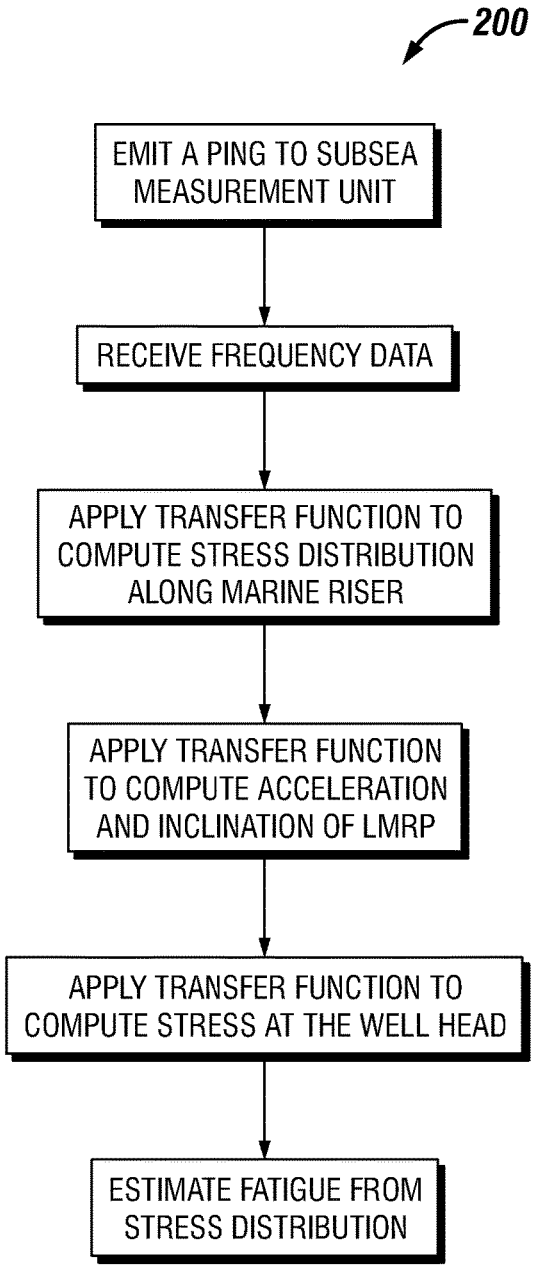
FIG. 5 is a flowchart of a software algorithm for the surface processing unit shown in FIG. 4.

Turning to FIG. 5, a flowchart 200 of a software algorithm is illustrated. The algorithm may be coded by machine instructions and may be executed by the computer 33. As shown in the flowchart 200, the machine instructions may cause the vessel transceiver 32 to emit a ping to the subsea inertial measurement unit 60. The ping may be emitted regularly, for example, every five seconds. Alternatively, the frequency of the ping may be varied. For example, it may be increased when a Global Positioning System (GPS) provided on the drilling rig 30 indicates that the drilling rig 30 is moving rapidly, and it may be decreased when the GPS indicates that the drilling rig 30 is stationary. As explained above, the ping triggers transmission of frequency data from to the subsea inertial measurement unit 60, which are received by the vessel transceiver 32 and communicated to the computer 33.

In some embodiments, the computer 33 is programmed to apply predetermined functions to the frequency data to compute stress levels at a plurality of locations along the riser 43 or the wellhead 50. For example, the subsea inertial measurement unit 60 may have computed the spectra of acceleration of the lower end of the riser 43 $A_r(f)$ (2 or 3 component vectors, depending on the number of axis of the accelerometer). The subsea inertial measurement unit 60 may also have computed the spectra of inclination of the lower end of the riser 43 $\theta_r(f)$ (also 2 or 3 component vectors, depending on the number of axis of the inclinometer). And the subsea inertial measurement unit 60 may have transmitted to the computer 33 acceleration vectors $A_r(f)$ and inclination vectors $\theta_r(f)$ corresponding to a given frequency f. The stress level vector σ (z,f) at a location z, being on the riser 43, at the wellhead 50, or anywhere along the marine riser system, is, in general, a 6 component vector that may be computed as expressed in Equation 1.

$$\sigma(z,f)=H^{\sigma}_{A}(z,f)\cdot A_r(f)+H^{\sigma}_{\theta}(z,f)\cdot\theta_r(f) \quad \text{(Eq. 1)}$$

Figure 7:
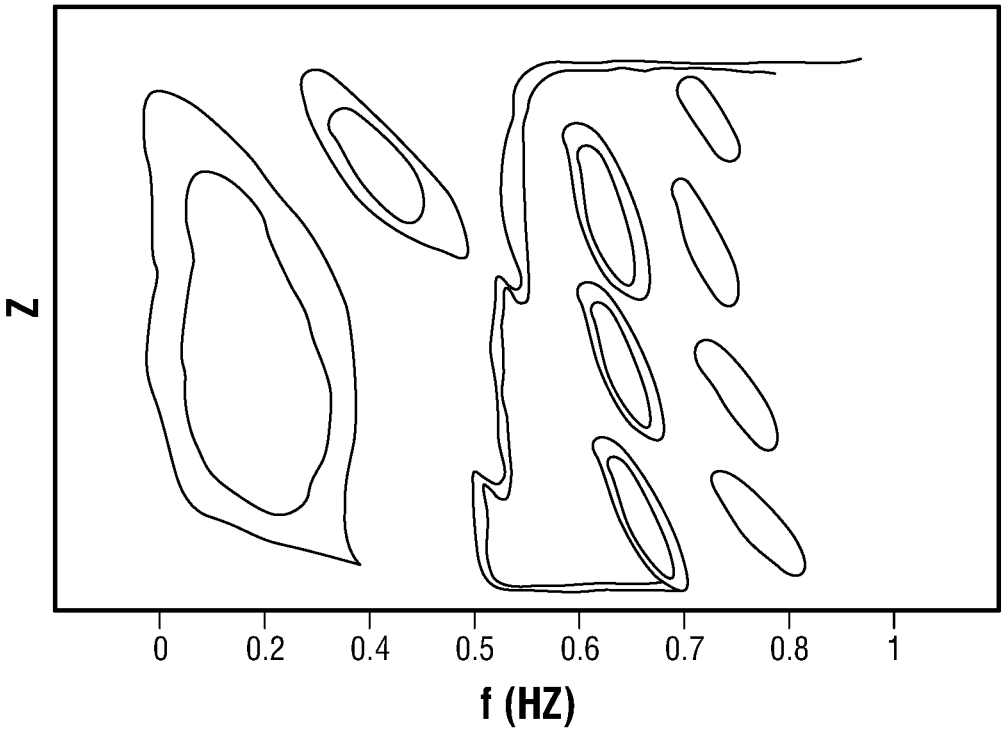
FIG. 7 is a graph of a spectral analysis of a marine riser showing contours of the magnitude of a function.

In Equation 1, $H^{\sigma}_{A}(z,f)$ and $H^{\sigma}_{\theta}(z,f)$ are predetermined matrix transfer functions. For example, these transfer functions may be determined by performing a spectral dynamic analysis of the wellbore 20, BOP 41, LMRP 42, and the lower end of the riser 43, subjected to the loading distribution that is typically encountered during operation at the frequency f. The spectral analysis may primarily be performed using Finite Element Analysis (see, e.g., FIG. 7). Alternatively, the transfer functions may be determined from measurements performed on a fully instrumented marine riser system previously operated that are optionally scaled to the dimensions of the marine riser system currently operated. Thus, the predetermined functions may include (matrix) transfer functions. However, the predetermined functions may also include relationships relating measured signals to stress levels or fatigue in the marine riser system expressed with regressions and/or neural networks.

Note that such transfer functions may be determined in cases where acceleration and inclination at a particular location are indications of the stress level vector to be determined. It is generally the case for acceleration and inclination measured at the bottom of the riser 43.

In some embodiments, the computer 33 is programmed to apply predetermined functions to the frequency data to compute the inclination or the acceleration of the LMRP 42. The acceleration vector of the LMRP $A_l(f)$ and/or the inclination vector of the LMRP $\theta_l(f)$ may be computed as expressed in Equations 2a and 2b.

$$A_l(f)=H^{A}_{A}(f)\cdot A_r(f)+H^{A}_{\theta}(f)\cdot\theta_r(f) \quad \text{(Eq. 2a)}$$

$$\theta_l(f)=H^{\theta}_{A}(f)\cdot A_r(f)+H^{\theta}_{\theta}(f)\cdot\theta_r(f) \quad \text{(Eq. 2b)}$$

In equations 2a and 2b, $H^{A}_{A}(f)$, $H^{A}_{\theta}(f)$, $H^{\theta}_{A}(f)$, and $H^{\theta}_{\theta}(f)$ are predetermined matrix transfer functions. For example, these transfer functions may be determined by performing a spectral dynamic analysis of the wellbore 20, BOP 41, LMRP 42, and riser 43 subjected to the loading distribution that is typically encountered during operation at the frequency f.

In some cases, transfer functions for determining the LMRP inclination $\theta_l(f)$ may not be computed via Finite Element Method (FEM). In these cases, approximate transfer functions may be determined experimentally.

In cases where the movement can be approximated a being locally rigid (e.g., in the absence of the flex joint 44), the dynamic spectral analysis may not be needed, and Equation 2a may be replaced by Equation 2a'.

$$A_l(f)=A_r(f)-i2\pi fK\theta_r(f) \quad \text{(Eq. 2a')}$$

In Equation 2a', K is a constant that is related to a distance between the location of the subsea inertial measurement unit 60 and the LMRP 42.

Again, the predetermined functions may thus include (matrix) transfer functions. However, the predetermined functions may also include relationships relating measured signals to stress levels or fatigue in the marine riser expressed with regressions and/or neural networks.

In some embodiments, the computer 33 may be programmed to display the difference between the inclination of the lower end of the riser 43, $\theta_r$, and the inclination of the LMRP 42, $\theta_l$. For example, the computer 33 may compute the time evolution of both inclinations by reverse Fourier transform. The computer 33 may further be programmed to transmit the difference between the inclination of the lower end of the riser 43 and the inclination of the LMRP 42 to the dynamic positioning system 35 for maintaining alignment of the derrick 31 with the wellbore axis 55.

In some embodiments, instead of computing the stress level at the wellhead 50 directly from the acceleration vectors $A_r(f)$ and inclination vectors $\theta_r(f)$ using Equation 1, the computer 33 may be programmed to first compute the inclination or the acceleration of the LMRP 42 as described herein, and then apply predetermined transfer functions to the inclination or the acceleration of the LMRP 42 to compute a load T (e.g., a bending moment, a force) at the wellhead 50, as expressed in Equation 3.

$$T(f)=H^{T}_{A}(f)\cdot A_r(f)+H^{T}_{\theta}(f)\cdot\theta_r(f) \quad \text{(Eq. 3)}$$

In Equation 3, $H^{T}_{A}(f)$ and $H^{T}_{\theta}(f)$ are predetermined matrix transfer functions. For example, these transfer functions may be determined by performing a spectral dynamic analysis of the wellbore 20, BOP 41, LMRP 42, and the lower end of the riser 43. The spectral analysis may be performed using Finite Element Method. FEM is data rich and may be used to determine several relationships that can be then applied to measurements performed with a monitoring system. Note that in several examples, only $H^{T}_{A}(f)$ may be used and $H^{T}_{\theta}(f)$ may be set to zero.

Yet again, the predetermined functions may thus include (matrix) transfer functions. However, the predetermined functions may also include relationships relating measured signals to stress levels or fatigue in the marine riser expressed with regressions and/or neural networks.

It should be noted that while the flowchart 200 is illustrated as sequential in FIG. 5, the application of the different functions may be carried out in parallel.

The computer 33 may further be programmed to compute and display fatigue of the riser 43 or the wellhead 50 based on the computed stress levels. For example, the time history of the stresses may be reconstructed by inverse Fourier transform, and the fatigue may be cumulated over time. However, fatigue may also be computed directly from frequency data, as known in the arts. In some cases, the computer 33 may broadcast the fatigue of the riser 43 or the wellhead 50 to a cloud computer. The fatigue of the riser 43 or the wellhead 50 may be stored on the cloud computer. The processed results may be displayed on the display 34 via a dynamic web page.

In the embodiments where the subsea inertial measurement unit 60 is configured to transmit low-pass filtered values of the time series data of the inclination $\theta_r$ (t) and acceleration $A_r(t)$ of the lower end of the riser 43 interleaved with frequency data, the computer 33 may further be programmed to compute the acceleration of the LMRP 42 $A_l(t)$ from the low-pass filtered values. For example, this computation may be performed with a simple model, equivalent to Equation 2a'.

$$A_l(t)=A_r(t)-K\,d\theta_r(t)/dt \quad \text{(Eq. 4)}$$

The inclination of the LMRP 42 may also be computed from the low-pass filtered values.

Optionally, the frequency spectra may be broadcasted from the surface processing unit 70 to a cloud computer instead of, or in addition to, executing the machine instructions coding the algorithm of FIG. 5 with the computer 33. The frequency spectra may be processed by the cloud computer using the predetermined functions (e.g., transfer function, relationship expressed with regression or neural networks). The processed results may be stored on the cloud computer. The processed results may be displayed on the display 34 via a dynamic web page.

Figure 6:
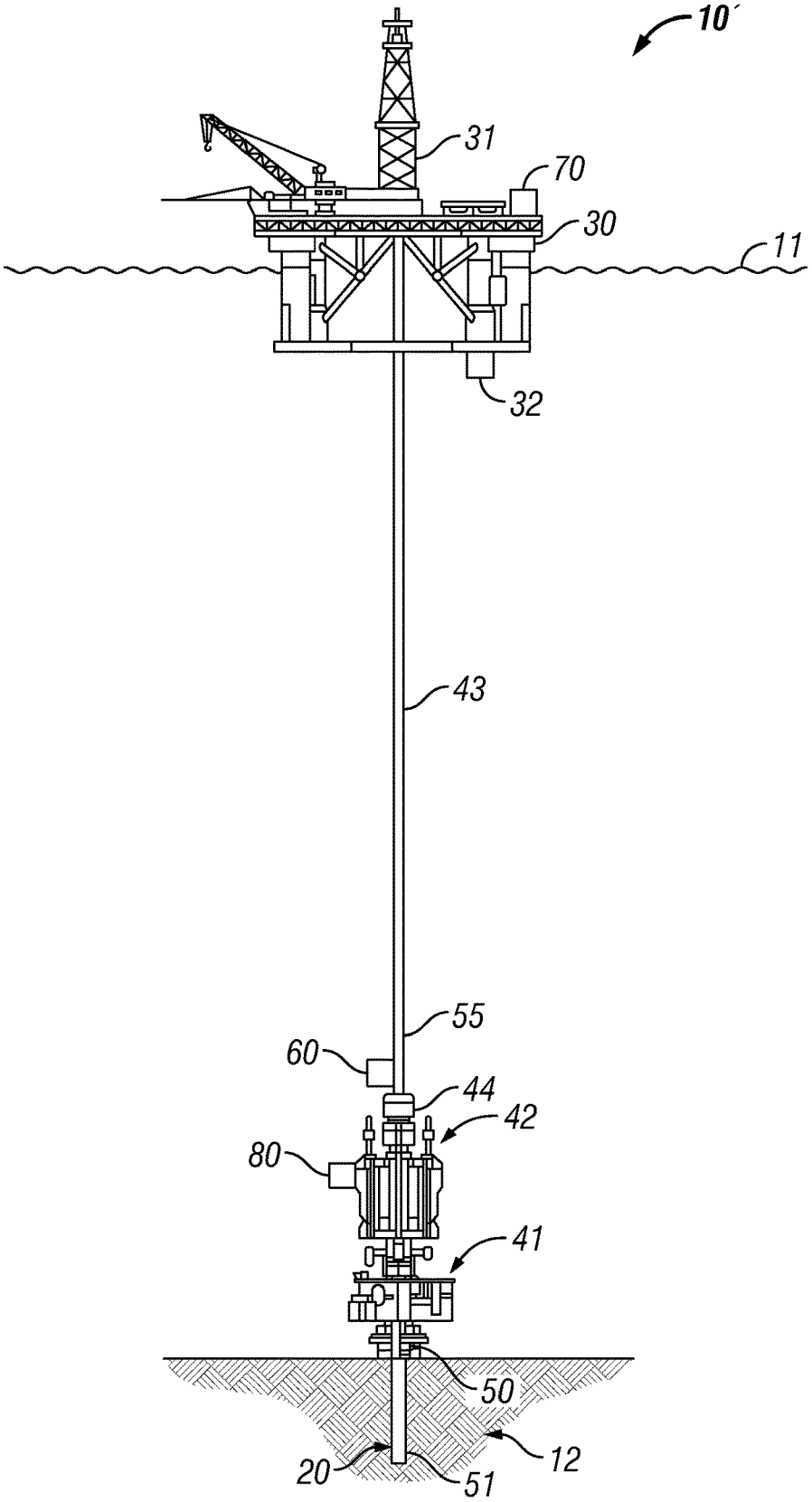
FIG. 6 is a monitoring system for a marine riser in accordance with another embodiment having two or more subsea inertial measurement units.

Turning now to FIG. 6, a monitoring system 10' for a marine riser system comprising two or more subsea inertial measurement units is illustrated. The monitoring system 10' comprises a first subsea inertial measurement unit 60 adapted for mounting to the lower end of the riser 43 and including means for acquiring time series data of inclination and acceleration and means for transmitting low-pass filtered values of the time series data to the vessel transceiver 32. The monitoring system 10' further comprises a second subsea inertial measurement unit 80 adapted for mounting to the LMRP 42 and including means for acquiring time series data of inclination and acceleration, and means for transmitting low-pass filtered values of the time series data to the vessel transceiver 32.

The means for transmitting low-pass filtered values of the time series data include a digital processing unit, for example, similar to the digital processing unit 62 described in FIG. 3, and a hydro-acoustic transponder coupled with electronic circuits to the digital processing unit, for example, similar to the hydro-acoustic transponder 61 coupled with the electronic circuits to the digital processing unit 62 also described in FIG. 3. Instead of, or in addition to, being programmed to compute frequency spectra, the digital processing unit is programmed to apply a low-pass filter to the buffered time series data for computing low-pass filtered data, to optionally resample the low-pass filtered data, and to encode a binary representation of low-pass filtered values (e.g., resampled low-pass filtered data) using phase-shift keying or equivalent. The means for transmitting low-pass filtered values of the time series data to the vessel transceiver may further be programmed to transmit a low-pass filtered value of the time series data of the inclination and/or acceleration upon receiving a ping from the vessel transceiver. Optionally, the means for transmitting low-pass filtered values of the time series data may share several components with the subsea inertial measurement unit 60 described in FIG. 3.

The monitoring system 10' comprises a surface processing unit 70 that is programmed to display the difference between the inclination of the lower end of the riser 43 and the inclination of the LMRP 42. The surface processing unit 70 may further be programmed to transmit the difference between the inclination of the lower end of the riser 43 and the inclination of the LMRP 42 to a dynamic positioning system 35.

The first subsea inertial measurement unit 60 may be configured to transmit frequency data interleaved with the low-pass filtered value of the time series data of the inclination and/or acceleration, as explained herein.

In view of the foregoing, and the appended Figures, those having ordinary skill in the art will appreciate that the following information may be obtained in at least the following way:

| | One subsea inertial measurement unit (e.g., FIG. 1) | Two subsea inertial measurement units (e.g., FIG. 6) |
|---|---|---|
| Riser Fatigue | From Eq. 1 | From Eq. 1 |
| Wellhead Fatigue | From Eq. 2a and Eq. 3 | From direct measurement and model |
| Riser Angle relative to LMRP | Riser low-pass filtered values and Eq. 2b | From Riser and LMRP low-pass filtered values |
| Angle (for Dynamic Positioning) | | |
| Natural Frequencies | From Riser Frequency data (spectrum) | From Riser and/or LMRP Frequency data (spectrum) |
| Damping | From Riser Frequency data (spectrum) | From Riser and/or LMRP Frequency data (spectrum) |

Further, those having ordinary skill in the art will appreciate that instated of, or in addition to measuring and processing inclinations and accelerations, first, second, and/or third time derivatives of position, and/or first derivatives of inclinations may be measured and processed to compute, for example, fatigue along the marine riser system.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents, and alternatives falling within the scope of the claims.

What is claimed is:

1. A monitoring system for a marine riser system, the marine riser system including a wellhead, a Lower Marine Riser Package (LMRP) and a riser, the LMRP being coupled to the wellhead, a lower end of the riser being coupled to the LMRP, the monitoring system comprising:

a first subsea inertial measurement unit adapted for mounting to the lower end of the riser and including means for acquiring time series data of inclination and acceleration, means for computing frequency spectra of the time series data, and means for transmitting data from the computed frequency spectra to a vessel transceiver; and a surface processing unit in communication with the vessel transceiver and programmed to apply predetermined functions to the transmitted data to compute stress levels at a plurality of locations along the riser, the LMRP, or the wellhead.

2. The monitoring system of claim 1, wherein the surface processing unit is further programmed to compute and display fatigue of the riser, the LMRP, or the wellhead based on the computed stress levels.

3. The monitoring system of claim 1 or 2, further comprising a second subsea inertial measurement unit adapted for mounting to the LMRP and including means for acquiring time series data of inclination and acceleration, means for computing frequency spectra of time series data, and means for transmitting data from the frequency spectra to the vessel transceiver.

4. The monitoring system of claim 1 or 2, wherein the means for transmitting data is programmed to transmit a rolling window of the frequency spectra to the vessel transceiver upon receiving a ping from the vessel transceiver.

5. The monitoring system of claim 4, wherein the means for transmitting data to the vessel transceiver is further programmed to transmit filtered values of the time series data of the inclination upon receiving the ping from the vessel transceiver.

6. The monitoring system of claim 1 or 2, wherein the means for computing frequency spectra of time series data is further programmed to compress the frequency spectra.

7. A monitoring system for a marine riser system, the marine riser system including a wellhead, a Lower Marine Riser Package (LMRP) and a riser, the LMRP being coupled to the wellhead, a lower end of the riser being coupled to the LMRP, the monitoring system comprising:

a subsea inertial measurement unit adapted for mounting to the lower end of the riser and including means for acquiring time series data of inclination and acceleration, means for computing frequency spectra of time series data, and means for transmitting data from the frequency spectra to a vessel transceiver; and a surface processing unit in communication with the vessel transceiver and programmed to apply predetermined functions to the transmitted data for computing the inclination or the acceleration of the LMRP.

8. The monitoring system of claim 7, wherein the surface processing unit is further programmed to display a difference between the inclination of the lower end of the riser and the inclination of the LMRP.

9. The monitoring system of claim 8, wherein the surface processing unit is further programmed to transmit the difference between the inclination of the lower end of the riser and the inclination of the LMRP to a dynamic positioning system.

10. The monitoring system of claim 7, 8 or 9, wherein the surface processing unit is further programmed to apply predetermined functions to the inclination or the acceleration of the LMRP for computing a load applied to the wellhead, and caused by the inclination or acceleration of the LMRP.

11. The monitoring system of claim 10, wherein the surface processing unit is further programmed to compute fatigue of the wellhead from the computed load applied to the wellhead and display the computed fatigue.

12. A monitoring system for a marine riser system, the marine riser system including a wellhead, a Lower Marine Riser Package (LMRP) and a riser, the LMRP being coupled to the wellhead, a lower end of the riser being coupled to the LMRP, the monitoring system comprising:

a first subsea inertial measurement unit adapted for mounting to the lower end of the riser and including means for acquiring time series data of inclination and acceleration and means for transmitting low-pass filtered values of the time series data to a vessel transceiver; and a surface processing unit in communication with the vessel transceiver and programmed to apply predetermined functions to the low-pass filtered values for computing the inclination or the acceleration of the LMRP.

13. The monitoring system of claim 12, wherein the surface processing unit is further programmed to display a difference between the inclination of the lower end of the riser and the inclination of the LMRP.

14. The monitoring system of claim 13, wherein the surface processing unit is further programmed to transmit the difference between the inclination of the lower end of the riser and the inclination of the LMRP to a dynamic positioning system.

15. The monitoring system of claim 12, 13, or 14, wherein the surface processing unit is further programmed to apply predetermined functions to the inclination or the acceleration of the LMRP for computing a load applied to the wellhead, and caused by the inclination or acceleration of the LMRP.

16. The monitoring system of claim 15, wherein the surface processing unit is further programmed to compute fatigue of the wellhead from the computed load applied to the wellhead and display the computed fatigue.

17. The monitoring system of claim 12, 13, or 14, further comprising a second subsea inertial measurement unit adapted for mounting to the LMRP and including means for acquiring time series data of inclination and acceleration, and means for transmitting low-pass filtered values of the time series data to the vessel transceiver.

* * * * *